US008428938B2

(12) United States Patent
Fang et al.

(10) Patent No.: US 8,428,938 B2
(45) Date of Patent: Apr. 23, 2013

(54) SYSTEMS AND METHODS FOR RECONSTRUCTING AN ERASED SPEECH FRAME

(75) Inventors: Zheng Fang, San Diego, CA (US); Daniel J. Sinder, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 982 days.

(21) Appl. No.: 12/478,460

(22) Filed: Jun. 4, 2009

(65) Prior Publication Data

US 2010/0312553 A1 Dec. 9, 2010

(51) Int. Cl.
*G10L 21/02* (2006.01)

(52) U.S. Cl.
USPC ..... 704/226

(58) Field of Classification Search ..... 704/226
See application file for complete search history.

(56) References Cited

U.S. PATENT DOCUMENTS

| | | | | |
|---|---|---|---|---|
| 7,519,535 | B2 | 4/2009 | Spindola | |
| 7,590,531 | B2 * | 9/2009 | Khalil et al. | 704/228 |
| 7,668,712 | B2 * | 2/2010 | Wang et al. | 704/219 |
| 7,831,421 | B2 * | 11/2010 | Khalil et al. | 704/228 |
| 7,962,335 | B2 * | 6/2011 | Khalil et al. | 704/228 |
| 8,000,961 | B2 * | 8/2011 | Gao | 704/225 |
| 2006/0173687 | A1 | 8/2006 | Spindola | |
| 2006/0206318 | A1 | 9/2006 | Kapoor et al. | |
| 2006/0206334 | A1 | 9/2006 | Kapoor et al. | |
| 2008/0052065 | A1 | 2/2008 | Kapoor et al. | |
| 2010/0057447 | A1 | 3/2010 | Ehara | |

FOREIGN PATENT DOCUMENTS

| | | | |
|---|---|---|---|
| CN | 101000768 | A | 7/2007 |
| CN | 101155140 | A | 4/2008 |
| EP | 1746580 | | 1/2007 |
| WO | 2008056775 | A1 | 5/2008 |

OTHER PUBLICATIONS

International Search Report—PCT/U S2010/037302—International Search Authority, European Patent Office, Aug. 31, 2010.
Written Opinion—PCT/US2010/037302—ISA/EPO—Aug. 31, 2010.

* cited by examiner

*Primary Examiner* — Susan McFadden
(74) *Attorney, Agent, or Firm* — Heejong Yoo

(57) ABSTRACT

A method for reconstructing an erased speech frame is described. A second speech frame is received from a buffer. The index position of the second speech frame is greater than the index position of the erased speech frame. The type of packet loss concealment (PLC) method to use is determined based on one or both of the second speech frame and a third speech frame. The index position of the third speech frame is less than the index position of the erased speech frame. The erased speech frame is reconstructed from one or both of the second speech frame and the third speech frame.

34 Claims, 8 Drawing Sheets

SYSTEMS AND METHODS FOR RECONSTRUCTING AN ERASED SPEECH FRAME

TECHNICAL FIELD

The present systems and methods relate to communication and wireless-related technologies. In particular, the present systems and methods relate to systems and methods for reconstructing an erased speech frame.

BACKGROUND

Digital voice communications have been performed over circuit-switched networks. A circuit-switched network is a network in which a physical path is established between two terminals for the duration of a call. In circuit-switched applications, a transmitting terminal sends a sequence of packets containing voice information over the physical path to the receiving terminal. The receiving terminal uses the voice information contained in the packets to synthesize speech.

Digital voice communications have started to be performed over packet-switched networks. A packet-switch network is a network in which the packets are routed through the network based on a destination address. With packet-switched communications, routers determine a path for each packet individually, sending it down any available path to reach its destination. As a result, the packets do not arrive at the receiving terminal at the same time or in the same order. A de-jitter buffer may be used in the receiving terminal to put the packets back in order and play them out in a continuous sequential fashion.

On some occasions, a packet is lost in transit from the transmitting terminal to the receiving terminal. A lost packet may degrade the quality of the synthesized speech. As such, benefits may be realized by providing systems and method for reconstructing a lost packet.

DETAILED DESCRIPTION

Figure 1:
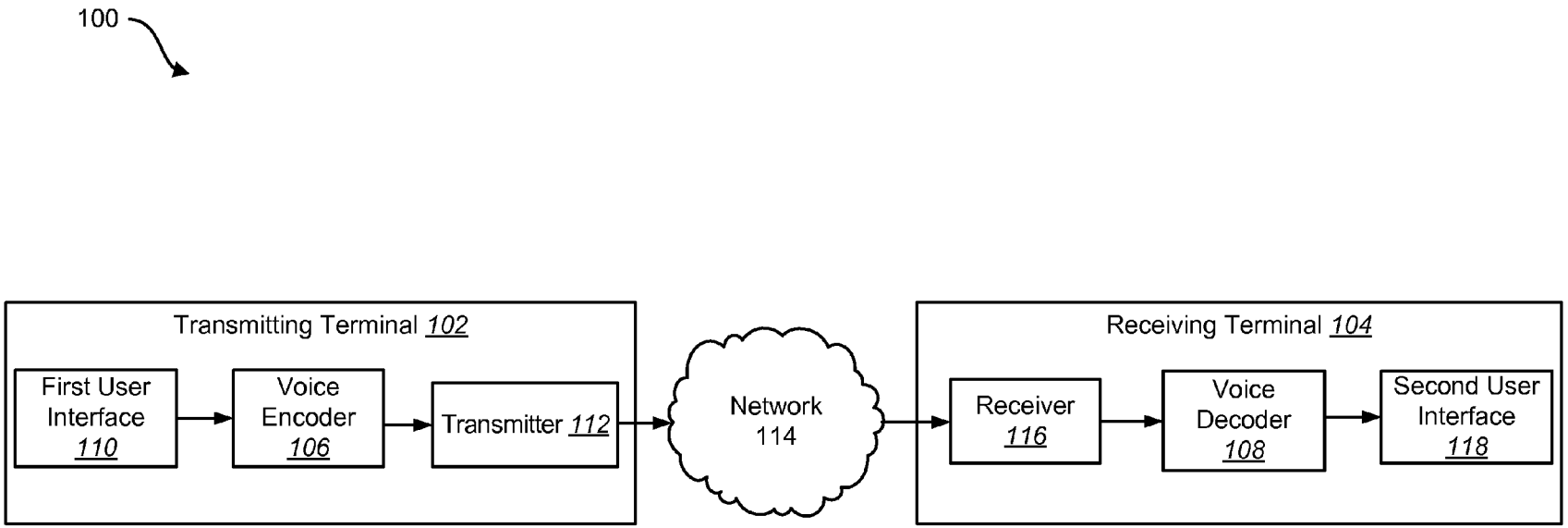
FIG. 1 is a block diagram illustrating an example of a transmitting terminal and a receiving terminal over a transmission medium.

Voice applications may be implemented in a packet-switched network. Packets with voice information may be transmitted from a first device to a second device on the network. However, some of the packets may be lost during the transmission of the packets. In one configuration, voice information (i.e., speech) may be organized in speech frames. A packet may include one or more speech frames. Each speech frame may be further partitioned into sub-frames. These arbitrary frame boundaries may be used where some block processing is performed. However, the speech samples may not be partitioned into frames (and sub-frames) if continuous processing rather than block processing is implemented. The loss of multiple speech frames (sometimes referred to as bursty loss) may be a reason for the degradation of perceived speech quality at a receiving device. In the described examples, each packet transmitted from the first device to the second device may include one or more frames depending on the specific application and the overall design constraints.

Data applications may be implemented in a circuit-switched network and packets with data may be transmitted from a first device to a second device on the network. Data packets may also be lost during the transmission of data. The conventional way to conceal the loss of a frame in a data packet in a circuit-switched system is to reconstruct the parameters of the lost frame through extrapolation from the previous frame with some attenuation. Packet (or frame) loss concealment schemes used by conventional systems may be referred to as conventional packet loss concealment (PLC). Extrapolation may include using the frame parameters or pitch waveform of the previous frame in order to reconstruct the lost frame. Although the use of voice communications in packet-switched networks (i.e., Voice over Internet Protocol (VoIP)) is increasing, the conventional PLC used in circuit-switched networks is also used to implement packet loss concealment schemes in packet-switched networks.

Although conventional PLC works reasonably well when there is a single frame loss in a steady voiced region; it may not be suitable for concealing the loss of a transition frame. In addition, conventional PLC may not work well for bursty frame losses either. However, in packet-switched networks, due to various reasons like high link load and high jitter, packet losses may be bursty. For example, three or more consecutive packets may be lost in packet-switched networks. In this circumstance, the conventional PLC approach may not be robust enough to provide a reasonably good perceptual quality to the users.

To provide an improved perceptual quality in packet-switched networks, an enhanced packet loss concealment scheme may be used. This concealment scheme may be referred to as an enhanced PLC utilizing future frames algorithm. The enhanced PLC algorithm may utilize a future frame (stored in a de-jitter buffer) to interpolate some or all of the parameters of the lost packet. In one example, the enhanced PLC algorithm may improve the perceived speech quality without affecting the system capacity. The present systems and methods described below may be used with numerous types of speech codecs.

A method for reconstructing an erased speech frame is disclosed. The method may include receiving a second speech frame from a buffer. The index position of the second speech frame may be greater than the index position of the erased speech frame. The method may also include determining which type of packet loss concealment (PLC) method to use based on one or both of the second speech frame and a third speech frame. The index position of the third speech frame may be less than the index position of the erased speech frame. The method may also include reconstructing the erased speech frame from one or both of the second speech frame and the third speech frame.

A wireless device for reconstructing an erased speech frame is disclosed. The wireless device may include a buffer configured to receive a sequence of speech frames. The wireless device may also include a voice decoder configured to decode the sequence of speech frames. The voice decoder may include a frame erasure concealment module configured to reconstruct the erased speech frame from one or more frames that are of one of the following types: subsequent frames and previous frames. The subsequent frames may include an index position greater than the index position of the erased speech frame in the buffer. The previous frames may include an index position less than the index position of the erased speech frame in the buffer.

An apparatus for reconstructing an erased speech frame is disclosed. The apparatus may include means for receiving a second speech frame from a buffer. The index position of the second speech frame may be greater than the index position of the erased speech frame. The apparatus may also include means for determining which type of packet loss concealment (PLC) method to use based on one or both of the second speech frame and a third speech frame. The index position of the third speech frame may be less than the index position of the erased speech frame. The apparatus may also include means for reconstructing the erased speech frame from one or both of the second speech frame and the third speech frame.

A computer-program product for reconstructing an erased speech frame is disclosed. The computer-program product may include a computer readable medium having instructions thereon. The instructions may include code for receiving a second speech frame from a buffer. The index position of the second speech frame may be greater than the index position of the erased speech frame. The instructions may also include code for determining which type of packet loss concealment (PLC) method to use based one or both of the second speech frame and a third speech frame. The index position of the third speech frame may be less than the index position of the erased speech frame. The instructions may also include code for reconstructing the erased speech frame from one or both of the second speech frame and the third speech frame.

FIG. 1 is a block diagram 100 illustrating an example of a transmitting terminal 102 and a receiving terminal 104 over a transmission medium. The transmitting and receiving terminals 102, 104 may be any devices that are capable of supporting voice communications including phones, computers, audio broadcast and receiving equipment, video conferencing equipment, or the like. In one configuration, the transmitting and receiving terminals 102, 104 may be implemented with wireless multiple access technology, such as Code Division Multiple Access (CDMA) capability. CDMA is a modulation and multiple access scheme based on spread-spectrum communications.

The transmitting terminal 102 may include a voice encoder 106 and the receiving terminal 104 may include a voice decoder 108. The voice encoder 106 may be used to compress speech from a first user interface 110 by extracting parameters based on a model of human speech generation. A transmitter 112 may be used to transmit packets including these parameters across the transmission medium 114. The transmission medium 114 may be a packet-based network, such as the Internet or a corporate intranet, or any other transmission medium. A receiver 116 at the other end of the transmission medium 112 may be used to receive the packets. The voice decoder 108 may synthesize the speech using the parameters in the packets. The synthesized speech may be provided to a second user interface 118 on the receiving terminal 104. Although not shown, various signal processing functions may be performed in both the transmitter and receiver 112, 116 such as convolutional encoding including cyclic redundancy check (CRC) functions, interleaving, digital modulation, spread spectrum processing, jitter buffering, etc.

Each party to a communication may transmit as well as receive. Each terminal may include a voice encoder and decoder. The voice encoder and decoder may be separate devices or integrated into a single device known as a "vocoder." In the detailed description to follow, the terminals 102, 104 will be described with a voice encoder 106 at one end of the transmission medium 114 and a voice decoder 108 at the other.

In at least one configuration of the transmitting terminal 102, speech may be input from the first user interface 110 to the voice encoder 106 in frames, with each frame further partitioned into sub-frames. These arbitrary frame boundaries may be used where some block processing is performed. However, the speech samples may not be partitioned into frames (and sub-frames) if continuous processing rather than block processing is implemented. In the described examples, each packet transmitted across the transmission medium 114 may include one or more frames depending on the specific application and the overall design constraints.

The voice encoder 106 may be a variable rate or fixed rate encoder. A variable rate encoder may dynamically switch between multiple encoder modes from frame to frame, depending on the speech content. The voice decoder 108 may also dynamically switch between corresponding decoder modes from frame to frame. A particular mode may be chosen for each frame to achieve the lowest bit rate available while maintaining acceptable signal reproduction at the receiving terminal 104. By way of example, active speech may be encoded using coding modes for active speech frames. Background noise may be encoded using coding modes for silence frames.

The voice encoder 106 and decoder 108 may use Linear Predictive Coding (LPC). With LPC encoding, speech may be modeled by a speech source (the vocal cords), which is characterized by its intensity and pitch. The speech from the vocal cords travels through the vocal tract (the throat and mouth), which is characterized by its resonances, which are called "formants." The LPC voice encoder may analyze the speech by estimating the formants, removing their effects from the speech, and estimating the intensity and pitch of the residual speech. The LPC voice decoder at the receiving end may synthesize the speech by reversing the process. In particular, the LPC voice decoder may use the residual speech to create the speech source, use the formants to create a filter (which represents the vocal tract), and run the speech source through the filter to synthesize the speech.

Figure 2:
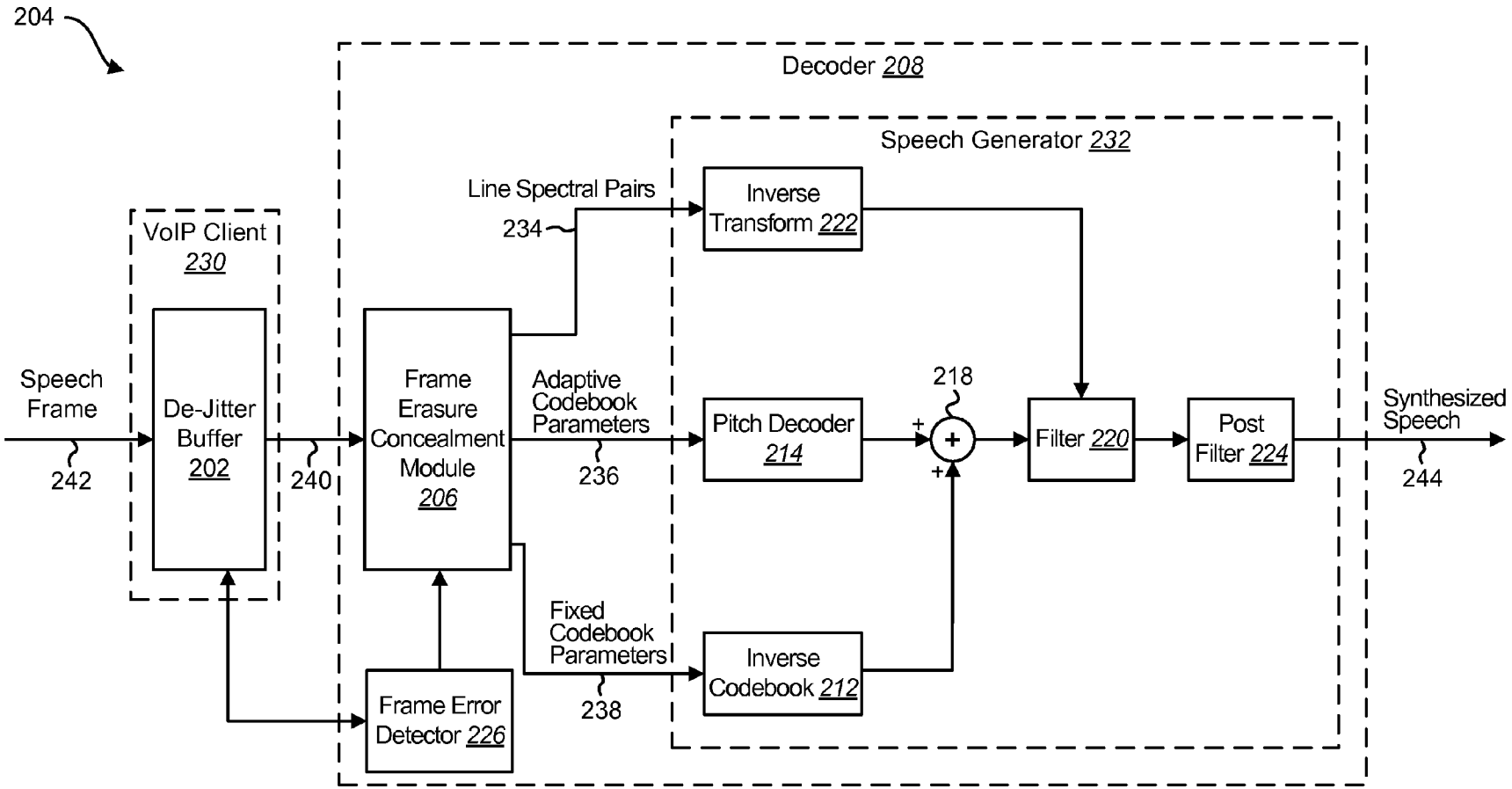
FIG. 2 is a block diagram illustrating a further configuration of the receiving terminal.

FIG. 2 is a block diagram of a receiving terminal 204. In this configuration, a VoIP client 230 includes a de-jitter buffer 202, which will be more fully discussed below. The receiving terminal 204 also includes one or more voice decoders 208. In one example, the receiving terminal 204 may include an LPC based decoder and two other types of codecs (e.g., voiced speech coding scheme and unvoiced speech coding scheme). The decoder 208 may include a frame error detector 226, a frame erasure concealment module 206 and a speech generator 232. The voice decoder 208 may be implemented as part of a vocoder, as a stand-alone entity, or distributed across one or more entities within the receiving terminal 204. The voice decoder 208 may be implemented as hardware, firmware, software, or any combination thereof. By way of example, the voice decoder 208 may be implemented with a microprocessor, digital signal processor (DSP), programmable logic, dedicated hardware or any other hardware and/or software based processing entity. The voice decoder 208 will be described below in terms of its functionality. The manner in which it is implemented may depend on the particular application and the design constraints imposed on the overall system.

The de-jitter buffer 202 may be a hardware device or software process that eliminates jitter caused by variations in packet arrival time due to network congestion, timing drift, and route changes. The de-jitter buffer 202 may receive speech frames 242 in voice packets. In addition, the de-jitter buffer 202 may delay newly-arriving packets so that the lately-arrived packets can be continuously provided to the speech generator 232, in the correct order, resulting in a clear connection with little audio distortion. The de-jitter buffer 202 may be fixed or adaptive. A fixed de-jitter buffer may introduce a fixed delay to the packets. An adaptive de-jitter buffer, on the other hand, may adapt to changes in the network's delay. The de-jitter buffer 202 may provide frame information 240 to the frame erasure concealment module 206, as will be discussed below.

As previously mentioned, various signal processing functions may be performed by the transmitting terminal 102 such as convolutional encoding including cyclic redundancy check (CRC) functions, interleaving, digital modulation, and spread spectrum processing. The frame error detector 226 may be used to perform the CRC check function. Alternatively, or in addition to, other frame error detection techniques may be used including a checksum and parity bit. In one example, the frame error detector 226 may determine whether a frame erasure has occurred. A "frame erasure" may mean either that the frame was lost or corrupted. If the frame error detector 226 determines that the current frame has not been erased, the frame erasure concealment module 206 may release the speech frames 242 that were stored in the de-jitter buffer 202. The parameters of the speech frames 242 may be the frame information 240 that is passed to the frame erasure concealment module 206. The frame information 240 may be communicated to and processed by the speech generator 232.

If, on the other hand, the frame error detector 226 determines that the current frame has been erased, it may provide a "frame erasure flag" to the frame erasure concealment module 206. In a manner to be described in greater detail later, the frame erasure concealment module 206 may be used to reconstruct the voice parameters for the erased frame.

The voice parameters, whether released from the de-jitter buffer 202 or reconstructed by the frame erasure concealment module 206, may be provided to the speech generator 232 to generate synthesized speech 244. The speech generator 232 may include several functions in order to generate the synthesized speech 244. In one example, an inverse codebook 212 may use fixed codebook parameters 238. For example, the inverse codebook 212 may be used to convert fixed codebook indices to residual speech and apply a fixed codebook gain to that residual speech. Pitch information may be added 218 back into the residual speech. The pitch information may be computed by a pitch decoder 214 from the "delay." The pitch decoder 214 may be a memory of the information that produced the previous frame of speech samples. Adaptive codebook parameters 236, such as adaptive codebook gain, may be applied to the memory information in each sub-frame by the pitch decoder 214 before being added 218 to the residual speech. The residual speech may be run through a filter 220 using line spectral pairs 234, such as the LPC coefficient from an inverse transform 222, to add the formants to the speech. Raw synthesized speech may then be provided from the filter 220 to a post-filter 224. The post-filter 224 may be a digital filter in the audio band that may smooth the speech and reduce out-of-band components. In another configuration, voiced speech coding schemes (such as PPP) and unvoiced speech coding schemes (such as NELP) may be implemented by the frame erasure concealment module 206.

The quality of the frame erasure concealment process improves with the accuracy in reconstructing the voice parameters. Greater accuracy in the reconstructed speech parameters may be achieved when the speech content of the frames is higher. In one example, silence frames may not include speech content, and therefore, may not provide any voice quality gains. Accordingly, in at least one configuration of the voice decoder 208, the voice parameters in a future frame may be used when the frame rate is sufficiently high to achieve voice quality gains. By way of example, the voice decoder 208 may use the voice parameters in both a previous and future frame to reconstruct the voice parameters in an erased frame if both the previous and future frames are encoded at a mode other than a silence encoding mode. In other words, the enhanced packet loss concealment will be used when both the previous and future frames are encoded at an active-speech coding mode. Otherwise, the voice parameters in the erased frame may be reconstructed from the previous frame. This approach reduces the complexity of the frame erasure concealment process when there is a low likelihood of voice quality gains. A "rate decision" from the frame error detector 226 (more fully discussed below) may be used to indicate the encoding mode for the previous and future frames of a frame erasure. In another configuration, two or more future frames may be in the buffer. When two or more future frames are in the buffer, a higher-rate frame may be chosen, even if the higher-rate frame is further away from the erased frame than a lower-rate frame.

Figure 3:
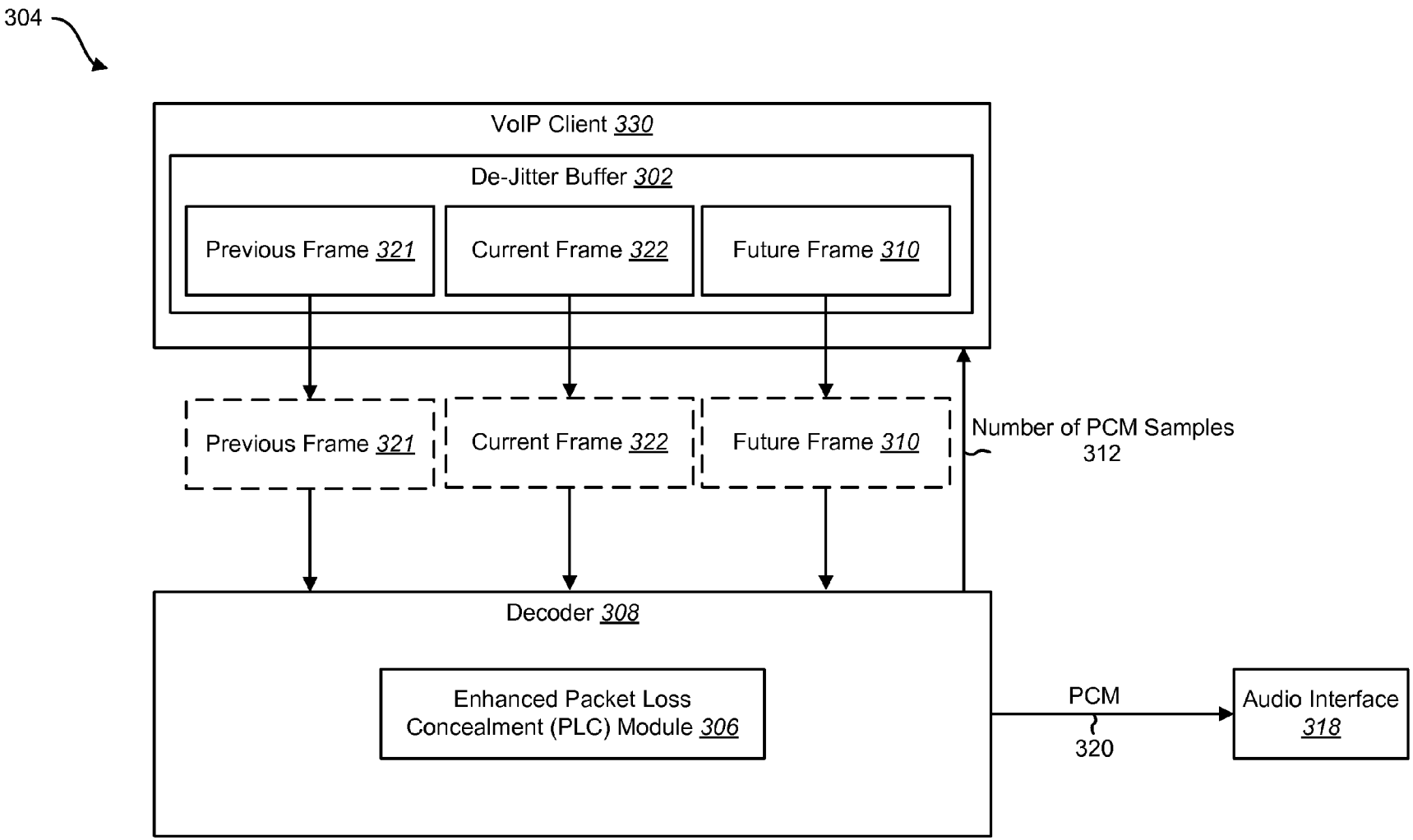
FIG. 3 is a block diagram illustrating one configuration of the receiving terminal with an enhanced packet loss concealment (PLC) module.

FIG. 3 is a block diagram illustrating one configuration of a receiving terminal 304 with an enhanced packet loss concealment (PLC) module 306 in accordance with the present systems and methods. The receiving terminal 304 may include a VoIP client 330 and a decoder 308. The VoIP client 330 may include a de-jitter buffer 302 and the decoder 308 may include the enhanced PLC module 306. The de-jitter buffer 302 may buffer one or more speech frames received by the VoIP client 330.

In one example, the VoIP client 330 receives real-time protocol (RTP) packets. The real-time protocol (RTP) defines a standardized packet format for delivering audio and video of a network, such as the Internet. In one configuration, the VoIP client 330 may decapsulate the received RTP packets into speech frames. In addition, the VoIP client 330 may reorder the speech frames in the de-jitter buffer 302. Further, the VoIP client 330 may supply the appropriate speech frame to the decoder 308. In one configuration, the decoder 308 provides a request to the VoIP client 330 for a particular speech frame. The VoIP client 330 may also receive a number of decoded pulse coded modulation (PCM) samples 312 from the decoder 308. In one example, the VoIP client 330 may use the information provided by the PCM samples 312 to adjust the behavior of the de-jitter buffer 302.

In one configuration, the de-jitter buffer 302 stores speech frames. The buffer 302 may store a previous speech frame 321, a current speech frame 322 and one or more future speech frames 310. As previously mentioned, the VoIP client 330 may receive packets out of order. The de-jitter buffer 302 may be used to store and reorder the speech frames of the packets into the correct order. If a speech frame is erased (e.g., frame erasure), the de-jitter buffer 302 may include one or more future frames (i.e., frames that occur after the erased frame). A frame may have an index position associated with the frame. For example, a future frame 310 may have a higher index position than the current frame 322. Likewise, the current frame 322 may have a higher index position than a previous frame 321.

As mentioned above, the decoder 308 may include the enhanced PLC module 306. In one configuration, the decoder 308 may be a non-wideband speech codecs or wideband speech codecs decoder. The enhanced PLC module 306 may reconstruct an erased frame using interpolation-based packet loss concealment techniques when a frame erasure occurs and at least one future frame 310 is available. If there is more than one future frame 310 available, the more accurate future frame may be selected. In one configuration, higher accuracy of a future frame may be indicated by a higher bit rate. Alternatively, higher accuracy of a future frame may be indicated by the temporal closeness of the frame. In one example, when a speech frame is erased the frame may not include meaningful data. For example, a current frame 322 may represent an erased speech frame. The frame 322 may be considered an erased frame because it 322 may not include data that enables the decoder 308 to properly decode the frame 322. When frame erasure occurs, and at least one future frame 310 is available in the buffer 302, the VoIP client 330 may send the future frame 310 and any related information to the decoder 308. The related information may be the current frame 322 that includes the meaningless data. The related information may also include the relative gap between the current erased frame and the available future frame. In one example, the enhanced PLC module 306 may reconstruct the current frame 322 using the future frame 310. Speech frames may be communicated to an audio interface 318 as PCM data 320.

In a system without enhanced PLC capability, the VoIP client 330 may interface with the speech decoder 308 by sending the current frame 322, the rate of the current frame 322, and other related information such as whether to do phase matching and whether and how to do time warping. When an erasure happens, the rate of the current frame 322 may be set to a certain value, such as frame erasure, when sent to the decoder 308. With enhanced PLC functionality enabled, the VoIP client 330 may also send the future frame 310, the rate of the future frame 310, and a gap indicator (further described below) to the decoder 308.

Figure 4:
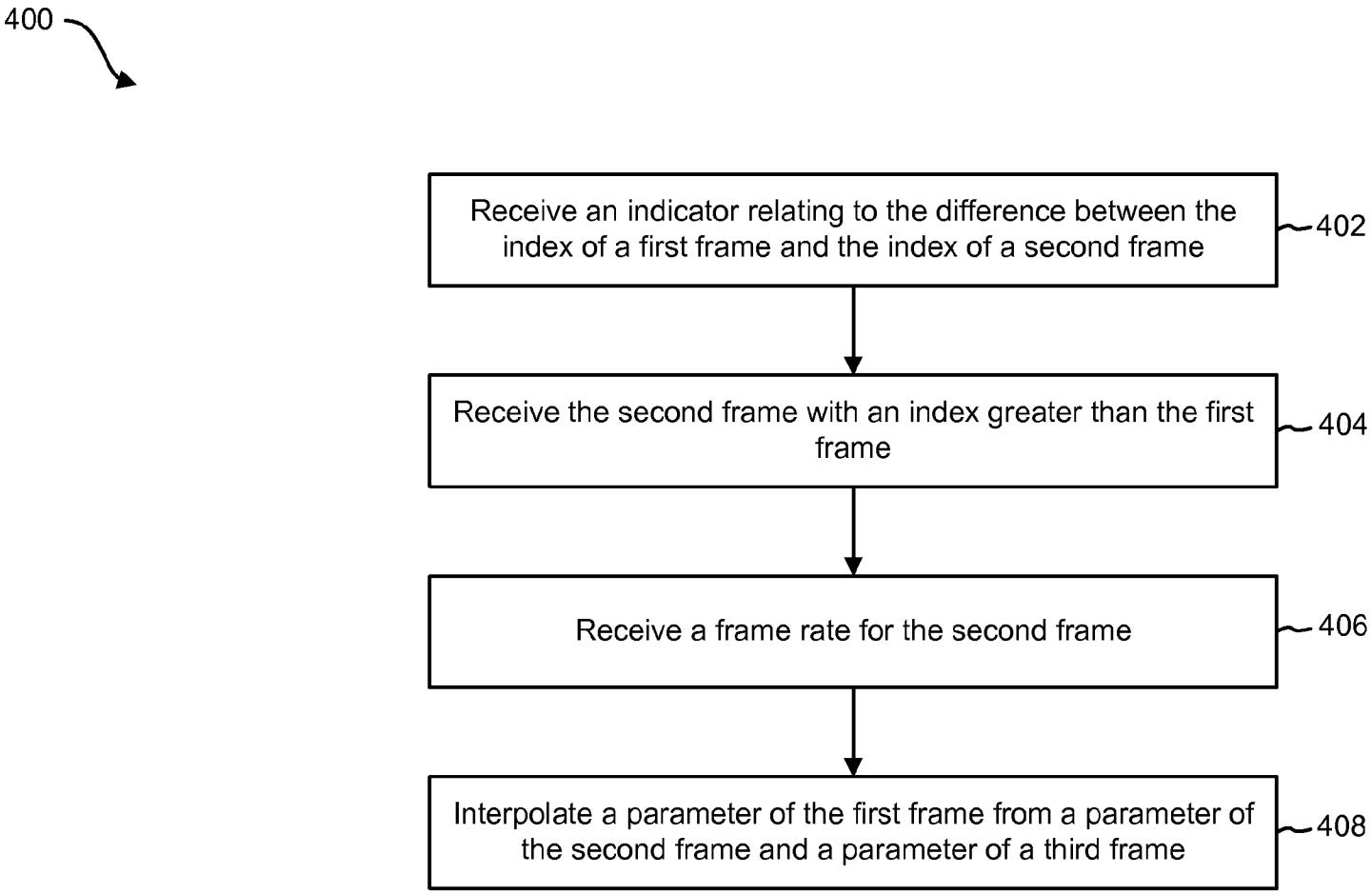
FIG. 4 is a flow diagram illustrating one example of a method for reconstructing a speech frame using a future frame.

FIG. 4 is a flow diagram illustrating one example of a method 400 for reconstructing a speech frame using a future frame. The method 400 may be implemented by the enhanced PLC module 206. In one configuration, an indicator may be received 402. The indicator may indicate the difference between the index position of a first frame and the index position of a second frame. For example, the first frame may have an index position of "4" and the second frame may have an index position of "7". From this example, the indicator may be "3".

In one example, the second frame may be received 404. The second frame may have an index position that is greater than the first frame. In other words, the second frame may be played back at a time subsequent to the playback of the first frame. In addition, a frame rate for the second frame may be received 406. The frame rate may indicate the rate an encoder used to encode the second frame. More details regarding the frame rate will be discussed below.

In one configuration, a parameter of the first frame may be interpolated 408. The parameter may be interpolated using a parameter of the second frame and a parameter of a third frame. The third frame may include an index position that is less than the first frame and the second frame. In other words, the third frame may be considered a "previous frame" in that the third frame is played back before the playback of the current frame and future frame.

Figure 5:
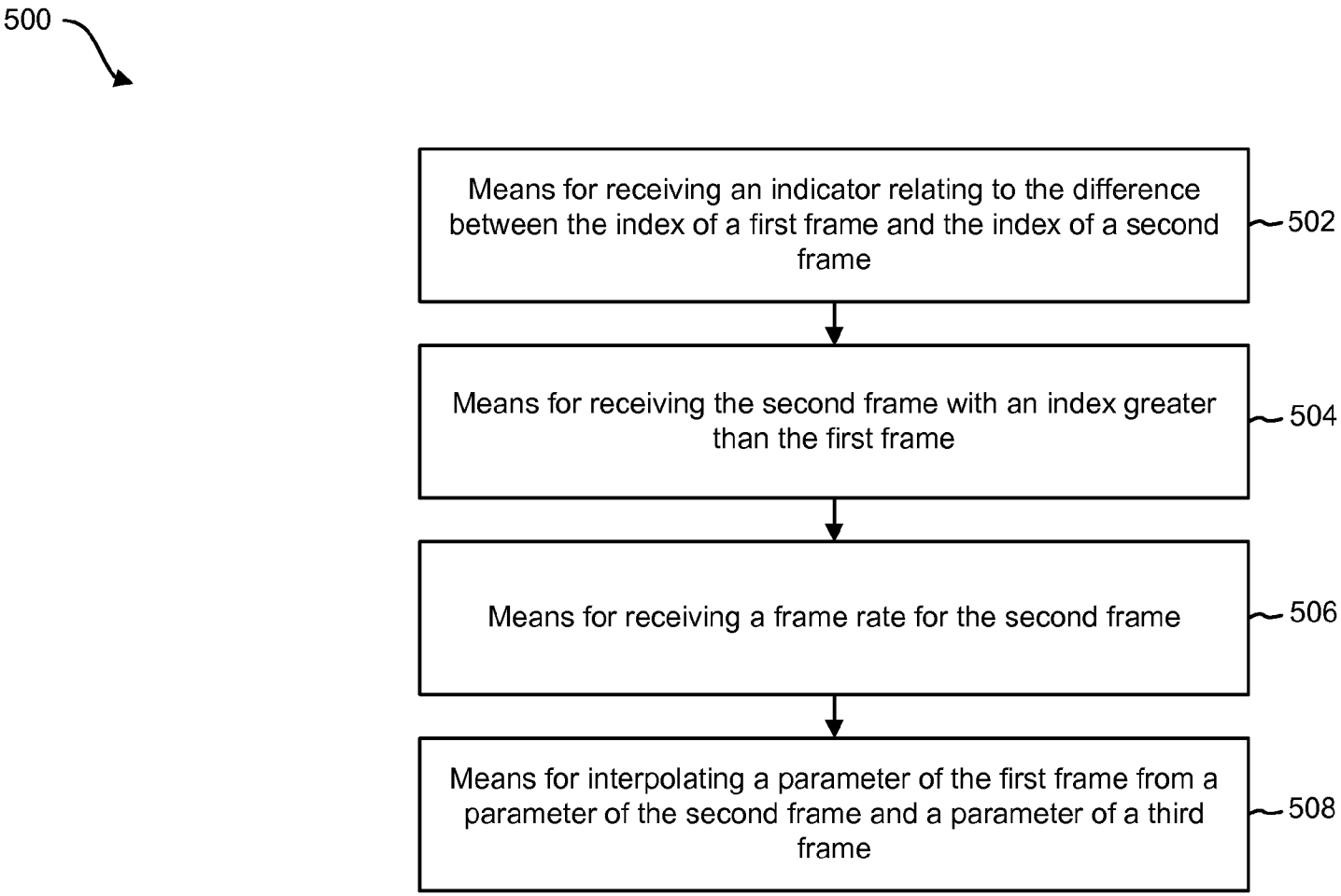
FIG. 5 illustrates means plus function blocks corresponding to the method shown in FIG. 4.

The method of FIG. 4 described above may be performed by various hardware and/or software component(s) and/or module(s) corresponding to the means-plus-function blocks illustrated in FIG. 5. In other words, blocks 402 through 408 illustrated in FIG. 4 correspond to means-plus-function blocks 502 through 508 illustrated in FIG. 5.

Figure 6:
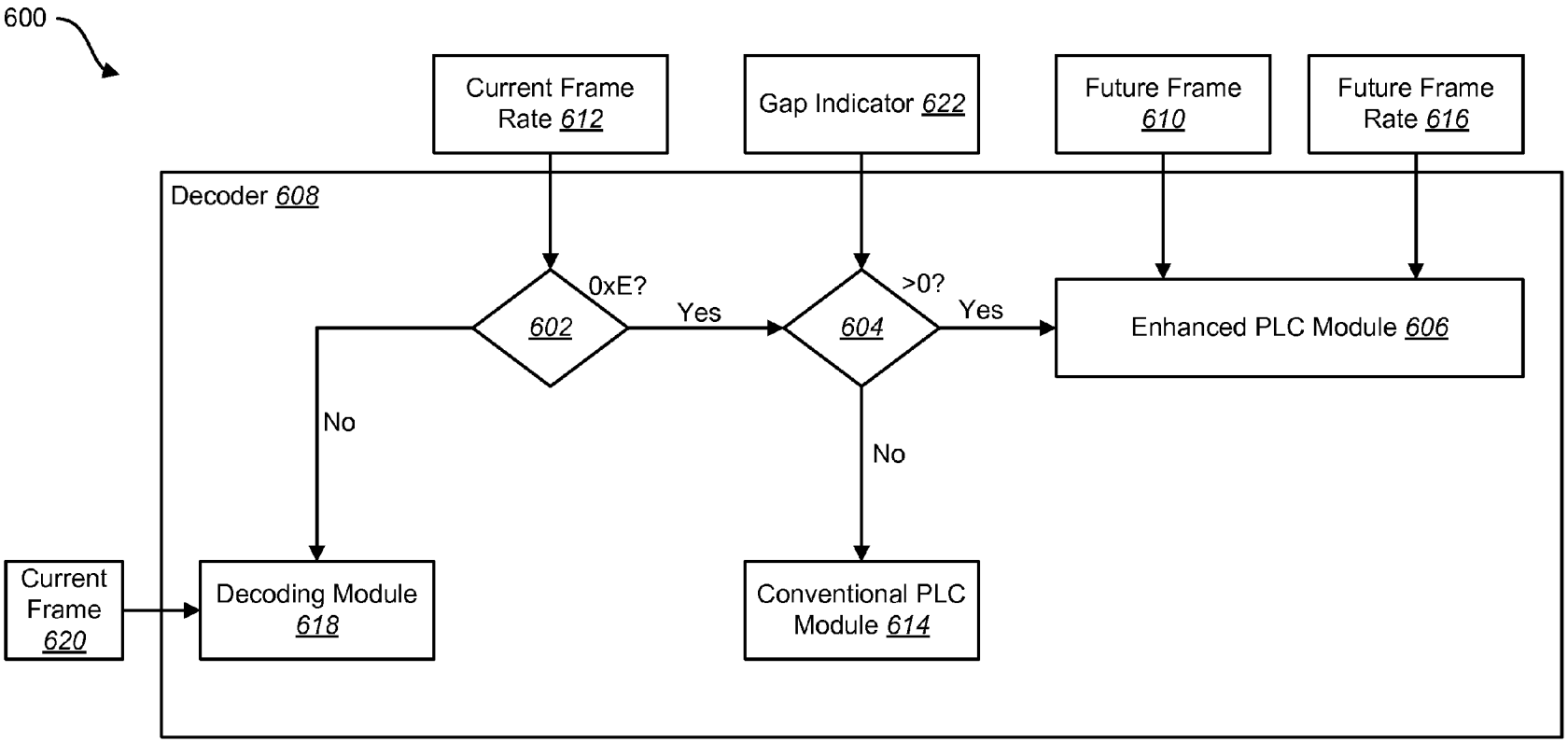
FIG. 6 is a flow diagram illustrating a further configuration of a method for concealing the loss of a speech frame.

FIG. 6 is a flow diagram illustrating a further configuration of a method 600 for concealing the loss of a speech frame within a packet. The method may be implemented by an enhanced PLC module 606 within a decoder 608 of a receiving terminal 104. A current frame rate 612 may be received by the decoder 608. A determination 602 made be made as to whether or not the current frame rate 612 includes a certain value that indicates a current frame 620 is erased. In one example, a determination 602 may be made as to whether or not the current frame rate 612 equals a frame erasure value. If it is determined 602 that the current frame rate 612 does not equal frame erasure, the current frame 620 is communicated to a decoding module 618. The decoding module 618 may decode the current frame 620.

However, if the current frame rate 612 suggests the current frame is erased, a gap indicator 622 is communicated to the decoder 608. The gap indicator 622 may be a variable that denotes the difference between frame indices of a future frame 610 and a current frame 620 (i.e., the erased frame). For example, if the current erased frame 620 is the $100^{th}$ frame in a packet and the future frame 610 is the $103^{rd}$ frame in the packet, the gap indicator 622 may equal 3. A determination 604 may be made as to whether or not the gap indicator 622 is greater than a certain threshold. If the gap indicator 622 is not greater than the certain threshold, this may imply that no future frames are available in the de-jitter buffer 202. A conventional PLC module 614 may be used to reconstruct the current frame 620 using the techniques mentioned above.

In one example, if the gap indicator 622 is greater than zero, this may imply that a future frame 610 is available in the de-jitter buffer 202. As previously mentioned, the future frame 610 may be used to reconstruct the erased parameters of the current frame 620. The future frame 610 may be passed from the de-jitter buffer 202 (not shown) to the enhanced PLC module 606. In addition, a future frame rate 616 associated with the future frame 610 may also be passed to the enhanced PLC module 606. The future frame rate 616 may indicate the rate or frame type of the future frame 610. For example, the future frame rate 616 may indicate that the future frame was encoded using a coding mode for active speech frames. The enhanced PLC module 606 may use the future frame 610 and a previous frame to reconstruct the erased parameters of the current frame 620. A frame may be a previous frame because the index position may be lower than the index position of the current frame 620. In other words, the previous frame is released from the de-jitter buffer 202 before the current frame 620.

Figure 7:
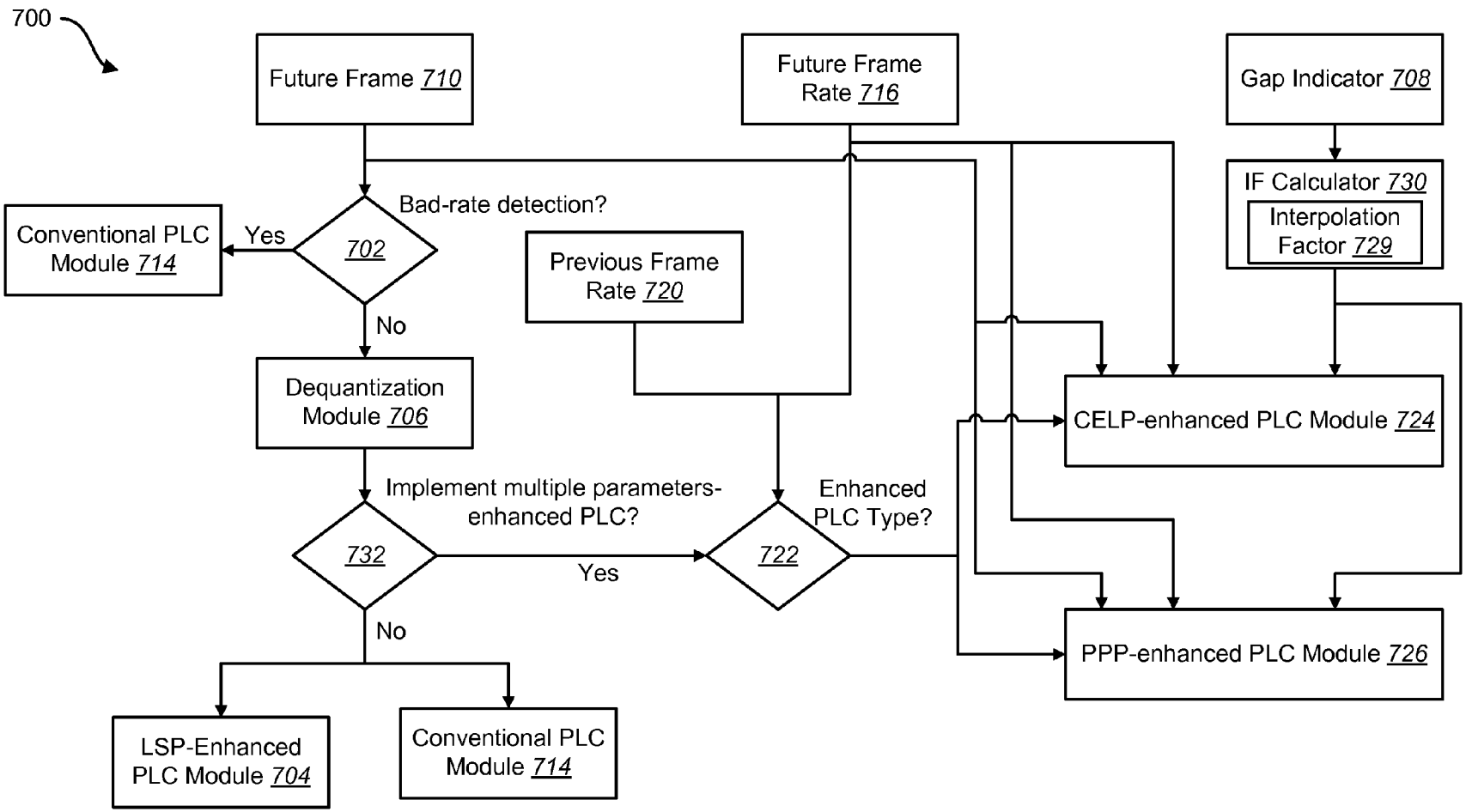
FIG. 7 is a flow diagram illustrating a further example of a method for concealing the loss of a speech frame.

FIG. 7 is a flow diagram illustrating a further example of a method 700 for concealing the loss of a speech frame within a packet. In one example, a current erased frame may be the n-th frame within a packet. A future frame 710 may be the (n+m)-th frame. A gap indicator 708 that indicates the difference between the index position of the current erased frame and the future frame 710 may be m. In one configuration, interpolation to reconstruct the erased n-th frame may be performed between a previous frame ((n−1)-th frame) and the future frame 710 (i.e., the (n+m)-th frame).

In one example, a determination 702 is made as to whether or not the future frame 710 includes a "bad-rate". The bad-rate detection may be performed on the future frame 710 in order to avoid data corruption during transmission. If it is determined that the future frame 710 does not pass the bad-rate detection determination 702, a conventional PLC module 714 may be used to reconstruct the parameters of the erased frame. The conventional PLC module 714 may implement prior techniques previously described to reconstruct the erased frame.

If the future frame 710 passed the bad-rate detection determination 702, the parameters in the future frame may be dequantized by a dequantization module 706. In one configuration, the parameters which are not used by the enhanced PLC module to reconstruct the erased frame may not be dequantized. For example, if the future frame 710 is a code excited linear prediction (CELP) frame, a fix-codebook index may not be used by the enhanced PLC module. As such, the fix-codebook index may not be dequantized.

For a decoder 108 that includes an enhanced PLC module 306, there may be different types of packet loss concealment methods that may be implemented when frame erasure occurs. Examples of these different methods may include: 1) The conventional PLC method, 2) a method to determine spectral envelope parameters, such as the line spectral pair (LSP)-enhanced PLC method, the linear predictive coefficients (LPC) method, the immittance spectral frequencies (ISF) method, etc., 3) the CELP-enhanced PLC method and 4) the enhanced PLC method for voiced coding mode.

In one example, the spectral envelope parameters-enhanced PLC method involves interpolating the spectral envelope parameters of the erased frame. The other parameters may be estimated by extrapolation, as performed by the conventional PLC method. In the CELP-enhanced PLC method, some or all of the excitation related parameters of the missing frame may also be estimated as a CELP frame using an interpolation algorithm. Similarly, in the voiced speech coding scheme-enhanced PLC method, some or all of the excitation related parameters of the erased frame may also be estimated as a voiced speech coding scheme frame using an interpolation algorithm. In one configuration, the CELP-enhanced PLC method and the voiced speech coding scheme-enhanced PLC method may be referred to as "multiple parameters-enhanced PLC methods". Generally, the multiple parameters-enhanced PLC methods involve interpolating some or all of the excitation related parameters and/or the spectral envelope parameters.

After the parameters of the future frame 710 are dequantized, a determination 732 may be made as to whether or not multiple parameters-enhanced PLC methods are implemented. The determination 732 is used to avoid unpleasant artifacts. The determination 732 may be made based on the types and rates of both the previous frame and the future frame. The determination 732 may also be made based on the similarity between the previous frame and the future frame. The similarity indicator may be calculated based on their spectrum envelope parameters, their pitch lags or the waveforms.

The reliability of multiple parameters-enhanced PLC methods may depend on how stationary short speech segments are between frames. For example, the future frame 710 and a previous frame 720 should be similar enough to provide a reliable reconstructed frame via multiple parameters-enhanced PLC methods. The ratio of an LPC gain of the future frame 710 to the LPC gain of the previous frame 720 may be a good measure of the similarity between the two frames. If the LPC gain ratio is too small or too large, using a multiple parameters-enhanced PLC method may result in a reconstructed frame with artifacts.

In one example, unvoiced regions in a frame tend to be random in nature. As such, enhanced PLC-based method may result in a reconstructed frame that produces a buzzy sound. Hence in the case when the previous frame 720 is an unvoiced frame, the multiple parameters-enhanced PLC methods (CELP-enhanced PLC and voiced speech coding scheme-enhanced PLC) may not be used. In one configuration, some criterions may be used to decide the characteristics of a frame, i.e., whether a frame is a voiced frame or an unvoiced frame. The criterions to classify a frame include the frame type, frame rate, the first reflection coefficient, zero crossing rate, etc.

When the previous frame 720 and the future frame 710 are not similar enough, or the previous frame 720 is an unvoiced frame, the multiple parameters-enhanced PLC methods may not used. In these cases, conventional PLC or spectral envelope parameters-enhanced PLC methods may be used. These methods may be implemented by a conventional PLC module 714 and a spectral envelope parameters-enhanced PLC module (respectively), such as the LSP-enhanced PLC module 704. The spectral envelope parameters-enhanced PLC method may be chosen when the ratio of the future frame's LPC gain to the previous frame's LPC gain is very small. Using the conventional PLC method in such situations may cause pop artifact at the boundary of the erased frame and the following good frame.

If it is determined 732 that multiple parameters-enhanced PLC methods may be used to reconstruct the parameters of an erased frame, a determination 722 may be made as to which type of enhanced PLC method (CELP-enhanced PLC or voiced speech coding scheme-enhanced PLC) should be used. For the conventional PLC method and the spectral envelope parameters-enhanced PLC method, the frame type of the reconstructed frame is the same as the previous frame before the reconstructed frame. However, this is not always the case for the multiple parameters-enhanced PLC methods. In previous systems, the coding mode used in concealing the current erased frame is the same as that of the previous frame. However, in the current systems and methods, the coding mode/type for the erased frame may be different from that of the previous frame and the future frame.

When the future frame 710 is not accurate (i.e., a low-rate coding mode), it 710 may not provide useful information in order to carry out an enhanced PLC method. Hence, when the future frame 710 is a low-accuracy frame, enhanced PLC may not be used. Instead, conventional PLC techniques may be used to conceal the frame erasure.

When the previous frame 720 before the current erased frame is a steady voiced frame, it may mean that it 720 is located in a steady-voice region. Hence the conventional PLC algorithm may try to reconstruct the missing frame aggressively. Conventional PLC may generate a buzzy artifact. Thus, when the previous frame 720 is a steady voiced frame and the future frame 710 is a CELP frame or an unvoiced speech coding frame, the enhanced PLC algorithm may be used for the frame erasure. Then, the CELP enhanced PLC algorithm may be used to avoid buzzy artifacts. The CELP enhanced PLC algorithm may be implemented by a CELP enhanced PLC module 724.

When the future frame 710 is an active speech prototype pitch period (FPPP) frame, the voiced speech coding scheme-enhanced PLC algorithm may be used. The voiced speech coding scheme-enhanced PLC algorithm may be implemented by a voiced speech coding scheme-enhanced PLC module 726 (such as a prototype pitch period (PPP)-enhanced PLC module).

In one configuration, a future frame may be used to do backward extrapolation. For example, if an erasure happens before an unvoiced speech coding frame, the parameters may be estimated from the future unvoiced speech coding frame. This is unlike the conventional PLC, where the parameters are estimated from the frame before the current erased frame.

The CELP-enhanced PLC module 724 may treat missing frames as CELP frames. In the CELP-enhanced PLC method, spectral envelope parameters, delay, adaptive codebook (ACB) gains and fix codebook (FCB) gains of the current erased frame (frame n) may be estimated by interpolation between the previous frame, frame (n−1) and the future frame, frame (n+m). The fix codebook index may be randomly generated, then the current erased frame may be reconstructed based on these estimated values.

When the future frame 710 is an active speech code-excited linear prediction (FCELP) frame, it 710 may include a delta-delay field, from which the pitch lag of the frame before the future frame 710 may be determined (i.e., frame (n+m−1). The delay of the current erased frame may be estimated by interpolation between the delay values of the (n−1)-th frame and the (n+m−1)-th frame. Pitch doubling/tripling may be detected and handled before the interpolation of delay values.

When the previous/future frames 720,710 are voiced speech coding frames or unvoiced speech coding frames, parameters such as adaptive codebook gains and fix codebook gains may not be present. In such cases, some artificial values for these parameters may be generated. For unvoiced speech coding frames, ACB gains and FCB gains may be set to zero. For voiced speech coding frames, FCB gains may be set to zero and ACB gains may be determined based on the ratio of pitch-cycle waveform energies in residual domain between the frame before the previous frame and the previous frame. For example, if the previous frame if not a CELP frame and the CELP mode is used to conceal the current erased frame, a module may be used to estimate the acb_gain from the parameters of the previous frame even if it is not a CELP frame.

For any coding method, to do enhanced PLC, parameters may be interpolated based on the previous frame and the future frames. A similarity indicator may be calculated to represent the similarity between the previous frame and the future frame. If the indicator is lower than some threshold (i.e., not very similar), then some parameters may not be estimated from enhanced PLC. Instead, conventional PLC may be used.

When there are one or more erasures between a CELP frame and a unvoiced speech coding frame, due to the attenuation during CELP erasure processing, the energy of the last concealed frame may be very low. This may cause energy discontinuity between the last concealed frame and the following good unvoiced speech coding frame. Unvoiced speech decoding schemes, as previously mentioned, may be used to conceal this last erased frame.

In one configuration, the erased frame may be treated as an unvoiced speech coding frame. The parameters may be copied from a future unvoiced speech coding frame. The decoding may be the same as regular unvoiced speech decoding except for a smoothing operation on the reconstructed residual signal. The smoothing is done based on the energy of the residual signal in the previous CELP frame and the energy of the residual signal in current frame to achieve the energy continuity.

In one configuration, the gap indicator 708 may be provided to an interpolation factor (IF) calculator 730. The IF 729 may be calculated as:

$$IF = \frac{1}{m+1} \quad \text{Equation 1}$$

A parameter of the erased frame n may be interpolated from the parameters of the previous frame (n−1) and the future frame 710 (n+m). An erased parameter, P, may be interpolated as:

$$P_n = (1-\mathrm{IF})*P_{n-1} + \mathrm{IF}*P_{n+m} \quad \text{Equation 2}$$

Implementing enhanced PLC methods in wideband speech codecs may be an extension from implementing enhanced PLC methods in non-wideband speech codecs. The enhanced PLC processing in the low-band of wideband speech codecs may be the same as enhanced PLC processing in non-wideband speech codecs. For the high-band parameters in wideband speech codecs, the following may apply: The high-band parameters may be estimated by interpolation when the low-band parameters are estimated by multiple parameters-enhanced PLC methods (i.e., CELP-enhanced PLC or voiced speech coding scheme-enhanced PLC).

When a frame erasure occurs and there is at least one future frame in the buffer 202, the de-jitter buffer 202 may be responsible to decide whether to send a future frame. In one configuration, the de-jitter buffer 202 will send the first future frame to the decoder 108 when the first future frame in the buffer is not a silence frame and when the gap indicator 708 is less than or equal to a certain value. For example, the certain value may be "4". However, in the situation when the previous frame 720 is reconstructed by conventional PLC methods and the previous frame 720 is the second conventional PLC frame in a row, the de-jitter buffer 202 may send the future frame 710 if the gap indicator is less than or equal to a certain value. For example, the certain value may be "2". In addition, in the situation when the previous frame 720 is reconstructed by conventional PLC methods and the previous frame 720 is at least the third conventional PLC frame in a row, the buffer 202 may not supply a future frame 710 to the decoder.

In one example, if there is more than one frame in the buffer 202, the first future frame may be sent to the decoder 108 to be used during enhanced PLC methods. When two or more future frames are in the buffer, a higher-rate frame may be chosen, even if the higher-rate frame is further away from the erased frame than a lower-rate frame. Alternatively, when two or more future frames are in the buffer, the frame which is temporally closest to the erased frame may be sent to the decoder 108, regardless of whether the temporally closest frame is a lower-rate frame than another future frame.

Figure 8:
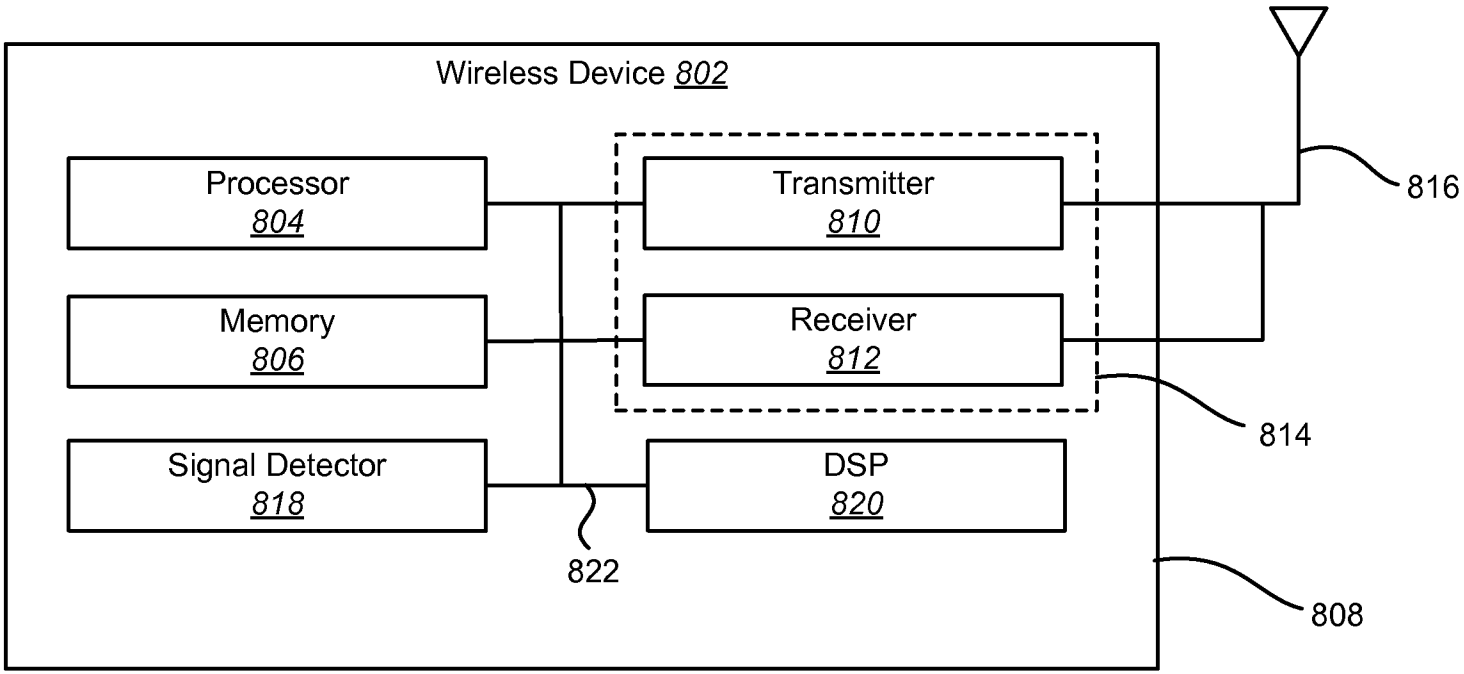
FIG. 8 illustrates various components that may be utilized in a wireless device.

FIG. 8 illustrates various components that may be utilized in a wireless device 802. The wireless device 802 is an example of a device that may be configured to implement the various methods described herein. The wireless device 802 may be a remote station.

The wireless device 802 may include a processor 804 which controls operation of the wireless device 802. The processor 804 may also be referred to as a central processing unit (CPU). Memory 806, which may include both read-only memory (ROM) and random access memory (RAM), provides instructions and data to the processor 804. A portion of the memory 806 may also include non-volatile random access memory (NVRAM). The processor 804 typically performs logical and arithmetic operations based on program instructions stored within the memory 806. The instructions in the memory 806 may be executable to implement the methods described herein.

The wireless device 802 may also include a housing 808 that may include a transmitter 810 and a receiver 812 to allow transmission and reception of data between the wireless device 802 and a remote location. The transmitter 810 and receiver 812 may be combined into a transceiver 814. An antenna 816 may be attached to the housing 808 and electrically coupled to the transceiver 814. The wireless device 802 may also include (not shown) multiple transmitters, multiple receivers, multiple transceivers and/or multiple antenna.

The wireless device 802 may also include a signal detector 818 that may be used to detect and quantify the level of signals received by the transceiver 814. The signal detector 818 may detect such signals as total energy, pilot energy per pseudonoise (PN) chips, power spectral density, and other signals. The wireless device 802 may also include a digital signal processor (DSP) 820 for use in processing signals.

The various components of the wireless device 802 may be coupled together by a bus system 822 which may include a power bus, a control signal bus, and a status signal bus in addition to a data bus. However, for the sake of clarity, the various busses are illustrated in FIG. 8 as the bus system 822.

As used herein, the term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The various illustrative logical blocks, modules and circuits described in connection with the present disclosure may be implemented or performed with a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be any commercially available processor, controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

The steps of a method or algorithm described in connection with the present disclosure may be embodied directly in hardware, in a software module executed by a processor or in a combination of the two. A software module may reside in any form of storage medium that is known in the art. Some examples of storage media that may be used include RAM memory, flash memory, ROM memory, EPROM memory, EEPROM memory, registers, a hard disk, a removable disk, a CD-ROM and so forth. A software module may comprise a single instruction, or many instructions, and may be distributed over several different code segments, among different programs and across multiple storage media. A storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware, or any combination thereof. If implemented in software, the functions may be stored as one or more instructions on a computer-readable medium. A computer-readable medium may be any available medium that can be accessed by a computer. By way of example, and not limitation, a computer-readable medium may comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

Further, it should be appreciated that modules and/or other appropriate means for performing the methods and techniques described herein, such as those illustrated by FIGS. 4-7, can be downloaded and/or otherwise obtained by a mobile device and/or base station as applicable. For example, such a device can be coupled to a server to facilitate the transfer of means for performing the methods described herein. Alternatively, various methods described herein can be provided via a storage means (e.g., random access memory (RAM), read only memory (ROM), a physical storage medium such as a compact disc (CD) or floppy disk, etc.), such that a mobile device and/or base station can obtain the various methods upon coupling or providing the storage means to the device. Moreover, any other suitable technique for providing the methods and techniques described herein to a device can be utilized.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for reconstructing an erased speech frame by a wireless device, comprising:

receiving a second speech frame from a buffer, wherein an index position of the second speech frame is greater than an index position of the erased speech frame;

determining which type of packet loss concealment (PLC) method to use based on one or both of the second speech frame and a third speech frame, wherein an index position of the third speech frame is less than the index position of the erased speech frame; and reconstructing the erased speech frame from one or both of the second speech frame and the third speech frame.

2. The method of claim 1, further comprising receiving an indicator, wherein the indicator indicates a difference between the index position of the erased speech frame and the index position of the second speech frame.

3. The method of claim 1, further comprising receiving a frame rate and a frame type associated with the second speech frame.

4. The method of claim 1, further comprising interpolating a parameter of the erased speech frame using a parameter of the second speech frame and a parameter of the third speech frame.

5. The method of claim 1, further comprising detecting the erased speech frame.

6. The method of claim 2, further comprising comparing the indicator to a threshold.

7. The method of claim 2, further comprising calculating an interpolation factor from the indicator.

8. The method of claim 7, wherein the interpolation factor is calculated as $$IF = \frac{1}{m+1},$$

wherein IF is the interpolation factor and m is the indicator.

9. The method of claim 1, further comprising selecting one of a plurality of techniques to reconstruct the erased speech frame.

10. The method of claim 9, wherein the erased speech frame is a code excited linear prediction (CELP) frame.

11. The method of claim 9, wherein the erased speech frame is a prototype pitch period (PPP) frame.

12. The method of claim 1, wherein the buffer comprises more than one speech frame, wherein index positions of some of the speech frames are greater than the index position of the erased speech frame and index positions of other speech frames are less than the index position of the erased speech frame.

13. The method of claim 12, further comprising selecting one of the speech frames within the buffer, wherein the speech frame is selected based on coding rate, coding type, or temporal closeness of the speech frame.

14. The method of claim 12, further comprising selecting one of the speech frames within the buffer, wherein the speech frame is selected based on a size of the frame in the buffer.

15. The method of claim 1, further comprising applying a bad-rate check to validate an integrity of the second speech frame.

16. The method of claim 1, wherein a frame type of the third speech frame is different than a frame type of the second speech frame.

17. The method of claim 1, further comprising determining whether to implement an enhanced packet loss concealment algorithm or a conventional packet loss concealment algorithm.

18. The method of claim 17, wherein an enhanced packet loss concealment algorithm is implemented, and further comprising determining whether artifacts are produced from the enhanced packet loss concealment algorithm.

19. The method of claim 17, wherein the determination is based on a frame rate and frame type of one or both of the second speech frame and the third speech frame.

20. The method of claim 17, wherein the determination is based on a similarity of the second speech frame and the third speech frame.

21. The method of claim 20, further comprising calculating the similarity based on a spectrum envelope estimate or pitch waveform.

22. The method of claim 1, further comprising selecting an interpolation factor based on characteristics of the second speech frame and the third speech frame.

23. The method of claim 1, further comprising estimating parameters of the erased speech frame using backward-extrapolation.

24. The method of claim 23, further comprising determining whether to use backward-extrapolation based on a frame type and characteristics of the second speech frame and the third speech frame.

25. The method of claim 1, further comprising interpolating a portion of parameters of the second frame to reconstruct the erased speech frame.

26. A wireless device for reconstructing an erased speech frame, comprising:

a buffer configured to receive a sequence of speech frames; and a voice decoder configured to decode the sequence of speech frames, wherein the voice decoder comprises:

a frame erasure concealment module configured to reconstruct the erased speech frame from one or more frames that are of one of the following types:

subsequent frames and previous frames, wherein the subsequent frames comprise an index position greater than the index position of the erased speech frame in the buffer and the previous frames comprise an index position less than the index position of the erased speech frame in the buffer.

27. The wireless device of claim 26, wherein the frame erasure concealment module is further configured to interpolate a parameter of the erased speech frame using a parameter of the one or more subsequent frames and a parameter of the one or more previous frames.

28. The wireless device of claim 26, wherein the voice decoder is further configured to detect the erased speech frame.

29. The wireless device of claim 26, wherein the frame erasure concealment module is further configured to receive an indicator, wherein the indicator indicates a difference between the index position of the erased speech frame and the index position of a second speech frame within the buffer.

30. The wireless device of claim 29, wherein the frame erasure concealment module is further configured to determine if the indicator is above a threshold.

31. The wireless device of claim 29, wherein the frame erasure concealment module is further configured to calculate an interpolation factor from the indicator.

32. The wireless device of claim 26, wherein the wireless device is a handset.

33. An apparatus for reconstructing an erased speech frame, comprising:

means for receiving a second speech frame from a buffer, wherein an index position of the second speech frame is greater than an index position of the erased speech frame;

means for determining which type of packet loss concealment (PLC) method to use based on one or both of the second speech frame and a third speech frame, wherein an index position of the third speech frame is less than the index position of the erased speech frame; and means for reconstructing the erased speech frame from one or both of the second speech frame and the third speech frame.

34. A computer-program product for reconstructing an erased speech frame, the computer-program product comprising a non-transitory computer readable medium having instructions thereon, the instructions comprising:

code for causing a wireless device to receive a second speech frame from a buffer, wherein an index position of the second speech frame is greater than an index position of the erased speech frame;

code for causing the wireless device to determine which type of packet loss concealment (PLC) method to use based on one or both of the second speech frame and a third speech frame, wherein an index position of the third speech frame is less than the index position of the erased speech frame; and code for causing the wireless device to reconstruct the erased speech frame from one or both of the second speech frame and the third speech frame.

* * * * *